US012251788B2

(12) United States Patent
Nagengast et al.

(10) Patent No.: US 12,251,788 B2
(45) **Date of Patent: *Mar. 18, 2025**

(54) POLISHING HEAD WITH LOCAL WAFER PRESSURE

(71) Applicant: Applied Materials, Inc., Santa Clara, CA (US)

(72) Inventors: Andrew Nagengast, Sunnyvale, CA (US); Steven M. Zuniga, Soquel, CA (US); Jay Gurusamy, Santa Clara, CA (US); Charles C. Garretson, Sunnyvale, CA (US); Vladimir Galburt, Santa Clara, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 11 days.

This patent is subject to a terminal disclaimer.

(21) Appl. No.: 18/630,886

(22) Filed: Apr. 9, 2024

(65) Prior Publication Data

US 2024/0253179 A1 Aug. 1, 2024

Related U.S. Application Data

(62) Division of application No. 17/512,284, filed on Oct. 27, 2021, now Pat. No. 11,986,923.

(Continued)

(51) Int. Cl.

| | |
|---|---|
| ***B24B 37/32*** | (2012.01) |
| ***B24B 37/005*** | (2012.01) |
| ***B24B 37/04*** | (2012.01) |

(52) U.S. Cl.

CPC ..... *B24B 37/32* (2013.01); *B24B 37/005* (2013.01); *B24B 37/04* (2013.01)

(58) Field of Classification Search

CPC ..... B24B 7/228; B24B 9/065; B24B 37/27; B24B 37/30; B24B 37/32; B24B 37/105;

(Continued)

(56) References Cited

U.S. PATENT DOCUMENTS 6,113,479 A 9/2000 Sinclair et al.
6,450,868 B1 * 9/2002 Zuniga ..... B24B 37/30 451/388

(Continued)

FOREIGN PATENT DOCUMENTS

JP 2003533359 A * 11/2003
JP 4386897 B2 12/2009

(Continued)

OTHER PUBLICATIONS

Machine translation of JP-2003533359-A (Year: 2003).*

(Continued)

*Primary Examiner* — Robert F Neibaur
(74) *Attorney, Agent, or Firm* — Patterson + Sheridan, LLP

(57) ABSTRACT

A polishing system includes a carriage arm having an actuator disposed on a lower surface thereof. The actuator includes a piston and a roller coupled to a distal end of the piston. The polishing system includes a polishing pad and a substrate carrier suspended from the carriage arm and configured to apply a pressure between a substrate and the polishing pad. The substrate carrier includes a housing, a retaining ring, and a membrane. The substrate carrier includes an upper load ring disposed in the housing. The roller of the actuator is configured to contact the upper load ring during relative rotation between the substrate carrier and the carriage arm. The actuator is configured to apply a (Continued)

load to a portion of the upper load ring thereby altering the pressure applied between the substrate and the polishing pad.

20 Claims, 6 Drawing Sheets

Related U.S. Application Data

(60) Provisional application No. 63/112,141, filed on Nov. 10, 2020.

(58) Field of Classification Search
CPC ... B24B 37/107; B24B 37/005; B24B 41/002; B24B 41/007; B24B 41/053; B24B 49/08; B24B 49/16
USPC ..... 451/41, 388, 398, 285–289
See application file for complete search history.

(56) References Cited

U.S. PATENT DOCUMENTS

| | | | | |
|---|---|---|---|---|
| 6,659,850 | B2 | 12/2003 | Korovin et al. | |
| 6,755,726 | B2 | 6/2004 | Chen et al. | |
| 9,381,613 | B2 * | 7/2016 | Leighton | B24B 41/061 |
| 10,040,166 | B2 | 8/2018 | Nabeya et al. | |
| 10,710,209 | B2 * | 7/2020 | Terakawa | H01L 21/67219 |
| 11,623,321 | B2 * | 4/2023 | Nagengast | B24B 49/16 451/287 |
| 2002/0115397 | A1 | 8/2002 | Kajiwara et al. | |
| 2006/0194519 | A1 | 8/2006 | Fuhriman et al. | |
| 2009/0176445 | A1 | 7/2009 | Spiegel | |
| 2012/0040591 | A1 | 2/2012 | Spiegel | |
| 2013/0324012 | A1 | 12/2013 | Fukushima et al. | |
| 2014/0273776 | A1 | 9/2014 | Leighton et al. | |
| 2016/0193712 | A1 * | 7/2016 | Komura | B24B 37/30 451/287 |
| 2019/0061098 | A1 * | 2/2019 | Kang | H01L 21/306 |
| 2021/0094146 | A1 | 4/2021 | Pachaiyappan et al. | |
| 2021/0154796 | A1 | 5/2021 | Zhang et al. | |
| 2022/0111848 | A1 | 4/2022 | Parks et al. | |
| 2022/0143779 | A1 | 5/2022 | Nagengast et al. | |

FOREIGN PATENT DOCUMENTS

| | | | |
|---|---|---|---|
| JP | 2015217445 | A | 12/2015 |
| JP | 2018171670 | A | 11/2018 |
| JP | 2019-201127 | A | 11/2019 |
| KR | 20030010621 | A | 2/2003 |
| TW | 288165 | B | 10/1996 |
| TW | 201808532 | A | 3/2018 |
| TW | I617393 | B | 3/2018 |
| TW | 201946726 | A | 12/2019 |
| TW | 202012106 | A | 4/2020 |
| TW | 202017698 | A | 5/2020 |
| TW | 202026103 | A | 7/2020 |
| WO | 2009102047 | A1 | 8/2009 |
| WO | 2013052071 | A1 | 4/2013 |

OTHER PUBLICATIONS

Taiwan Office Action dated May 31, 2024 for Application No. 110141624.
International Search Report dated Feb. 17, 2022 for Application No. PCT/US2021/056874.
Search Report for Taiwan Invention Patent Application No. 110141624 dated Jul. 20, 2023.
Taiwan Office Action dated Sep. 26, 2023, from TW Application No. 2022-544296.
Taiwan Office Action dated Jan. 31, 2024 for Application No. 110141624.
Korean Office Action dated Feb. 22, 2024 for Application No. 10-2022-7025819.
Japanese Office Action dated Jun. 25, 2024 for Application No. 2022-544296.

* cited by examiner

POLISHING HEAD WITH LOCAL WAFER PRESSURE

CROSS-REFERENCE TO RELATED APPLICATIONS

This application is a divisional application of U.S. patent application Ser. No. 17/512,284, filed Oct. 27, 2021, which claims benefit of U.S. provisional patent application Ser. No. 63/112,141, filed Nov. 10, 2020, each of which is herein incorporated by reference.

BACKGROUND

Field

Embodiments of the present disclosure generally relate to an apparatus and method for polishing and/or planarization of substrates. More particularly, embodiments of the disclosure relate to polishing heads utilized for chemical mechanical polishing (CMP).

Description of the Related Art

Chemical mechanical polishing (CMP) is commonly used in the manufacturing of semiconductor devices to planarize or polish a layer of material deposited on a crystalline silicon (Si) substrate surface. In a typical CMP process, the substrate is retained in a substrate carrier, e.g., polishing head, which presses the substrate towards a rotating polishing pad in the presence of a polishing fluid. Generally, the polishing fluid comprises an aqueous solution of one or more chemical constituents and nanoscale abrasive particles suspended in the aqueous solution. Material is removed across a material layer surface of the substrate in contact with the polishing pad through a combination of chemical and mechanical activity which is provided by the polishing fluid and the relative motion of the substrate and the polishing pad.

The substrate carrier includes a membrane having a plurality of different radial zones that contact the substrate. The membrane may include three or more zones, such as from 3 zones to 11 zones, for example, 3, 5, 7 or 11 zones. The zones are typically labeled from outer to inner (e.g., from zone 1 on the outside to zone 11 on the inside for an 11 zone membrane). Using the different radial zones, pressure applied to a chamber bounded by the backside of the membrane may be selected to control the center to edge profile of force applied by the membrane to the substrate, and consequently, to control the center to edge profile of force applied by the substrate against the polishing pad. Even using the different radial zones, a persistent problem with CMP is the occurrence of an edge effect, i.e., the over- or under-polishing of the outermost 5-10 mm of a substrate. The edge effect can be caused by a sharp rise in pressure between the substrate and the polishing pad around the perimeter portion of the substrate due to a knife edge effect, where a leading edge of the substrate is scraped along a top surface of the polishing pad. Current approaches of applying pressure to the different radial zones result in force being distributed across a large area of the substrate. Such distribution of applied load over a large area is incapable of preventing the edge effect mentioned above.

To mitigate the edge effect and to improve the resulting finish and flatness of the substrate surface, the polishing head includes a retaining ring surrounding the membrane. The retaining ring has a bottom surface for contacting the polishing pad during polishing and a top surface which is secured to the polishing head. Pre-compression of the polishing pad under the bottom surface of the retaining ring reduces the pressure increase at the perimeter portion of the substrate by moving the increased pressure region from underneath the substrate to underneath the retaining ring. However, resulting improvement in uniformity of the perimeter portion of the substrate is generally limited and proves to be inadequate for many applications.

Accordingly, what is needed in the art are apparatus and methods for solving the problems described above.

SUMMARY

Embodiments of the present disclosure generally relate to an apparatus and method for polishing and/or planarization of substrates. More particularly, embodiments of the disclosure relate to polishing heads utilized for chemical mechanical polishing (CMP).

In one embodiment, a polishing system includes a carriage arm having an actuator disposed on a lower surface thereof, the actuator including: a piston; and a roller coupled to a distal end of the piston; a polishing pad; and a substrate carrier suspended from the carriage arm and configured to apply a pressure between a substrate and the polishing pad, the substrate carrier including: a housing; a retaining ring coupled to the housing; a membrane coupled to the housing and spanning an inner diameter of the retaining ring, the membrane having a bottom portion configured to contact a substrate and a side portion extending orthogonally to the bottom portion, wherein the side portion includes an annular recess formed along an outer edge of the side portion, and wherein an annular sleeve is disposed in the annular recess; an upper load ring disposed in the housing, wherein the roller of the actuator is configured to contact the upper load ring during relative rotation between the substrate carrier and the carriage arm; a plurality of load pins disposed circumferentially in the housing, each of the plurality of load pins having a proximal end coupled to the upper load ring and a distal end coupled to a lower load ring; and the lower load ring disposed in the housing, the lower load ring having a flange portion coupled to the distal end of each of the plurality of load pins and a body portion extending orthogonally in relation to the flange portion, wherein the body portion contacts the annular sleeve disposed in the membrane; wherein actuation of the actuator is configured to apply a load to a portion of the upper load ring, one or more of the plurality of load pins, lower load ring, annular sleeve and outer edge region of the membrane thereby altering the pressure applied between the substrate and the polishing pad.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of the scope of the disclosure, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Before describing several exemplary embodiments of the apparatus and methods, it is to be understood that the disclosure is not limited to the details of construction or process steps set forth in the following description. It is envisioned that some embodiments of the present disclosure may be combined with other embodiments.

Figure 1A:
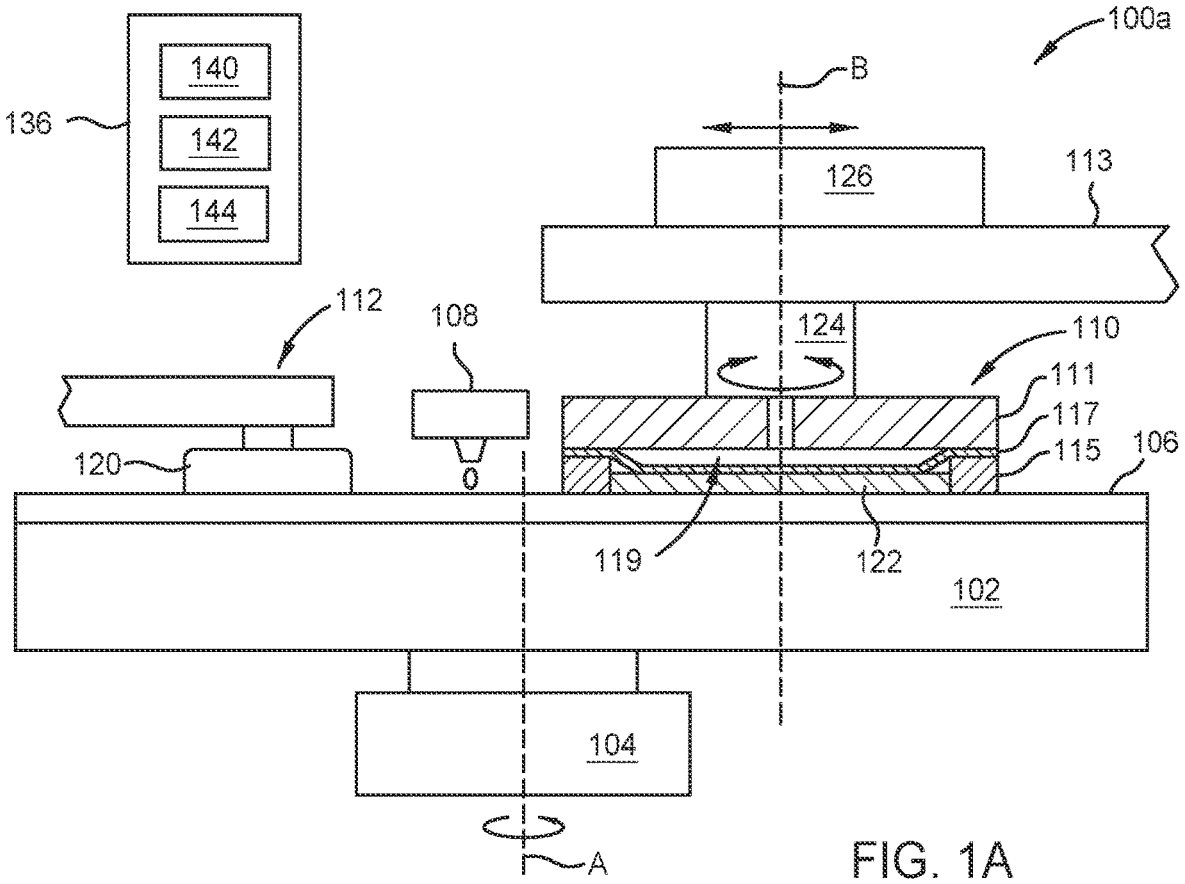
FIG. 1A is a schematic side view of an exemplary polishing station which may be used to practice the methods set forth herein, according to one or more embodiments.
Figure 1B:
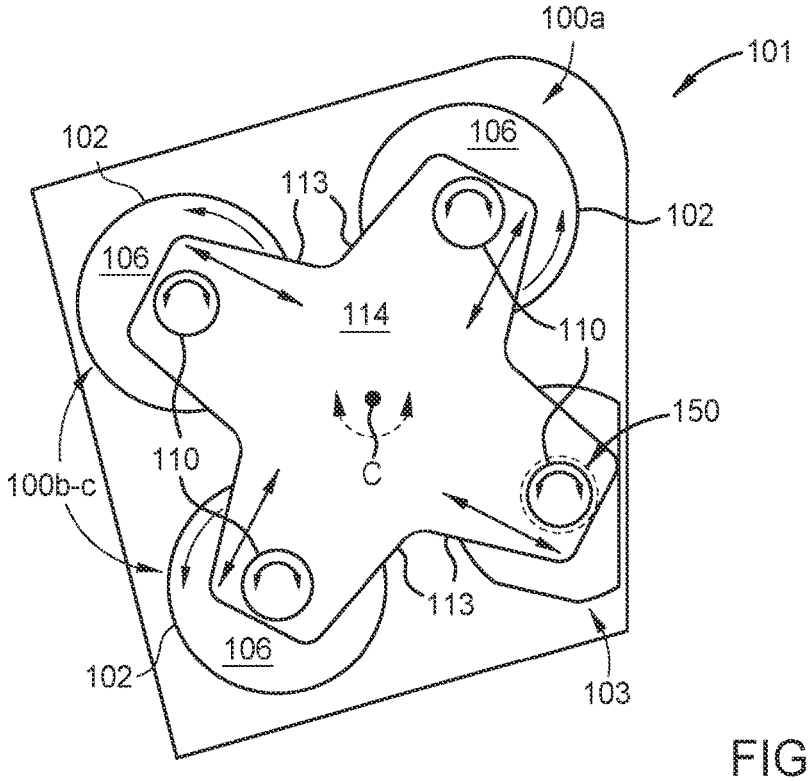
FIG. 1B is a schematic plan view of a portion of a multi-station polishing system which may be used to practice the methods set forth herein, according to one or more embodiments.

FIG. 1A is a schematic side view of a polishing station 100*a*, according to one or more embodiments, which may be used to practice the methods set forth herein. FIG. 1B is a schematic plan view of a portion of a multi-station polishing system 101 comprising a plurality of polishing stations 100*a-c*, where each of the polishing stations 100*b-c* are substantially similar to the polishing station 100*a* described in FIG. 1A. In FIG. 1B at least some of the components with respect to the polishing station 100*a* described in FIG. 1A are not shown on the plurality of polishing stations 100*a-c* in order to reduce visual clutter. Polishing systems that may be adapted to benefit from the present disclosure include REFLEXION® LK and REFLEXION® LK PRIME Planarizing Systems, available from Applied Materials, Inc. of Santa Clara, California, among others.

As shown in FIG. 1A, the polishing station 100*a* includes a platen 102, a first actuator 104 coupled to the platen 102, a polishing pad 106 disposed on the platen 102 and secured thereto, a fluid delivery arm 108 disposed over the polishing pad 106, a substrate carrier 110 (shown in cross-section), and a pad conditioner assembly 112. Here, the substrate carrier 110 is suspended from a carriage arm 113 of a carriage assembly 114 (FIG. 1B) so that the substrate carrier 110 is disposed over the polishing pad 106 and faces there towards. The carriage assembly 114 is rotatable about a carriage axis C to move the substrate carrier 110, and thus a substrate 122 chucked therein, between a substrate carrier loading station 103 (FIG. 1B) and/or between polishing stations 100*a-c* of the multi-station polishing system 101. The substrate carrier loading station 103 includes a load cup 150 (shown in phantom) for loading a substrate 122 to the substrate carrier 110.

During substrate polishing, the first actuator 104 is used to rotate the platen 102 about a platen axis A, and the substrate carrier 110 is disposed above the platen 102 and faces there towards. The substrate carrier 110 is used to urge a to-be-polished surface of a substrate 122 (shown in phantom), disposed therein, against the polishing surface of the polishing pad 106 while simultaneously rotating about a carrier axis B. Here, the substrate carrier 110 includes a housing 111, an annular retaining ring 115 coupled to the housing 111, and a membrane 117 spanning the inner diameter of the retaining ring 115. The retaining ring 115 surrounds the substrate 122 and prevents the substrate 122 from slipping from the substrate carrier 110 during polishing. The membrane 117 is used to apply a downward force to the substrate 122 and for loading (chucking) the substrate into the substrate carrier 110 during substrate loading operations and/or between substrate polishing stations. For example, during polishing, a pressurized gas is provided to a carrier chamber 119 to exert a downward force on the membrane 117 and thus a downward force on the substrate 122 in contact therewith. Before and after polishing, a vacuum may be applied to the chamber 119 so that the membrane 117 is deflected upwards to create a low pressure pocket between the membrane 117 and the substrate 122, thus chucking the substrate 122 into the substrate carrier 110.

During polishing, the substrate 122 is urged against the pad 106 in the presence of a polishing fluid provided by the fluid delivery arm 108. The rotating substrate carrier 110 oscillates between an inner radius and an outer radius of the platen 102 to, in part, reduce uneven wear of the surface of the polishing pad 106. Here, the substrate carrier 110 is rotated using a first actuator 124 and is oscillated using a second actuator 126.

Here, the pad conditioner assembly 112 comprises a fixed abrasive conditioning disk 120, e.g., a diamond impregnated disk, which may be urged against the polishing pad 106 to rejuvenate the surface thereof and/or to remove polishing byproducts or other debris therefrom. In other embodiments, the pad conditioner assembly 112 may comprise a brush (not shown).

Operation of the multi-station polishing system 101 and/or the individual polishing stations 100*a-c* thereof is facilitated by a system controller 136 (FIG. 1A). The system controller 136 includes a programmable central processing unit (CPU 140) which is operable with a memory 142 (e.g., non-volatile memory) and support circuits 144. The support circuits 144 are conventionally coupled to the CPU 140 and comprise cache, clock circuits, input/output subsystems, power supplies, and the like, and combinations thereof coupled to the various components of the polishing system 101, to facilitate control of a substrate polishing process. For example, in some embodiments the CPU 140 is one of any form of general purpose computer processor used in an industrial setting, such as a programmable logic controller (PLC), for controlling various polishing system component and sub-processors. The memory 142, coupled to the CPU 140, is non-transitory including one or more of readily available memory such as random access memory (RAM), read only memory (ROM), floppy disk drive, hard disk, or any other form of digital storage, local or remote.

Herein, the memory 142 is in the form of a computer-readable storage media containing instructions (e.g., non-volatile memory), that when executed by the CPU 140, facilitates the operation of the polishing system 101. The instructions in the memory 142 are in the form of a program product such as a program that implements the methods of the present disclosure (e.g., middleware application, equipment software application etc.). The program code may conform to any one of a number of different programming languages. In one example, the disclosure may be implemented as a program product stored on computer-readable storage media for use with a computer system. The program(s) of the program product define functions of the embodiments (including the methods described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure.

Figure 2A:
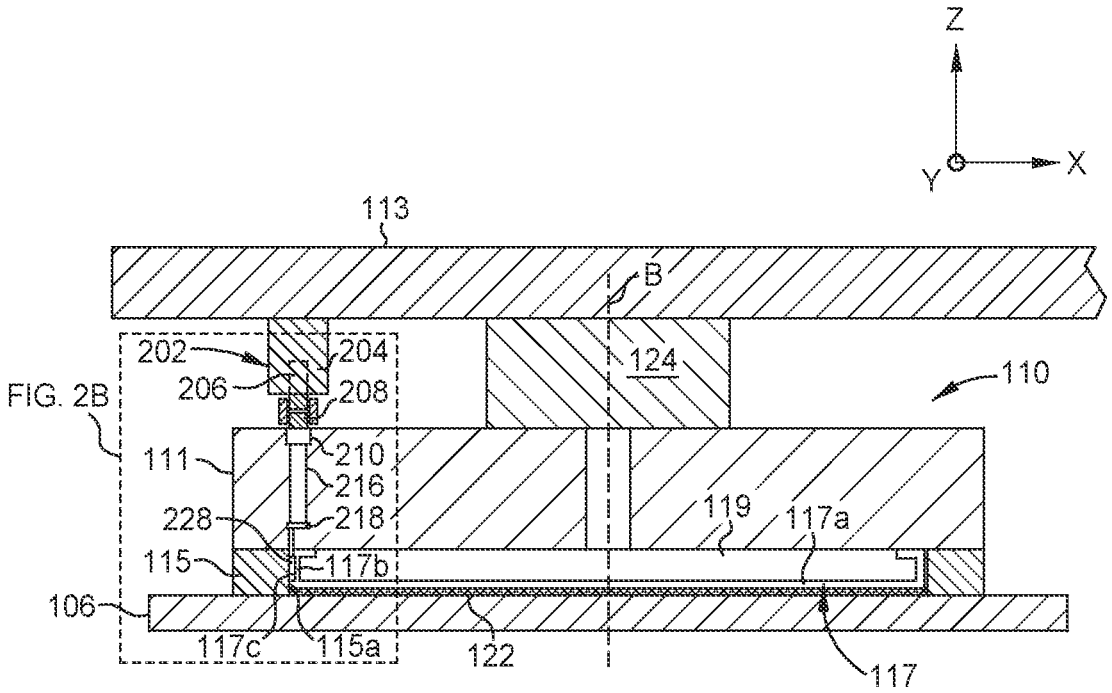
FIG. 2A is a schematic side view of one embodiment of a substrate carrier that may be used in the polishing system of FIG. 1B.
Figure 2B:
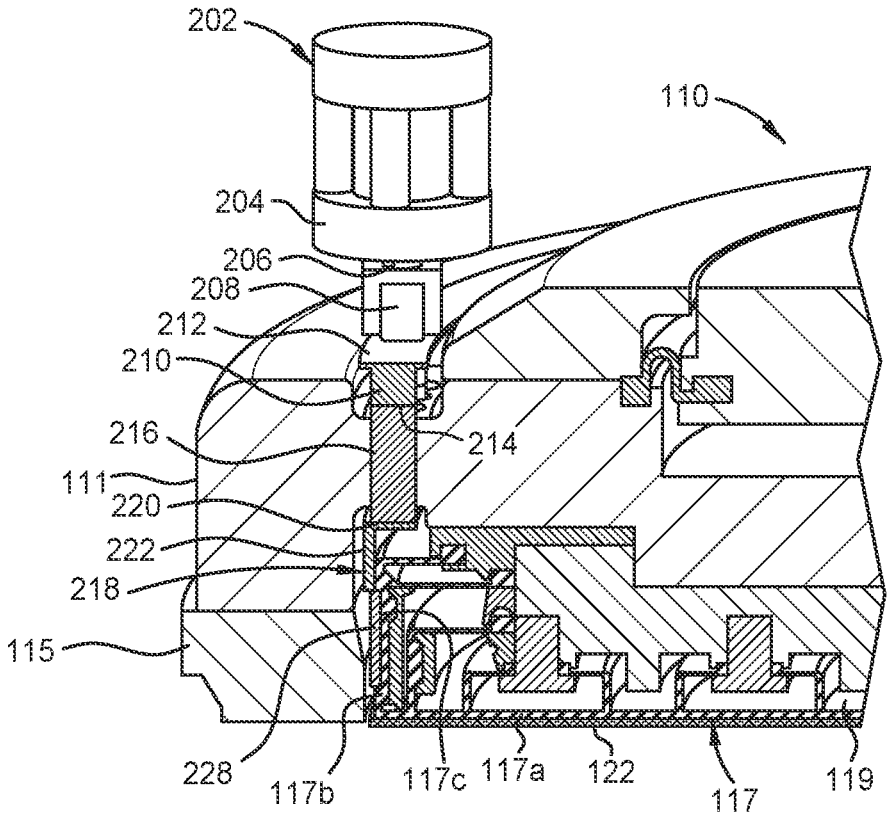
FIG. 2B is an enlarged side sectional view of a portion of FIG. 2A.
Figure 2C:
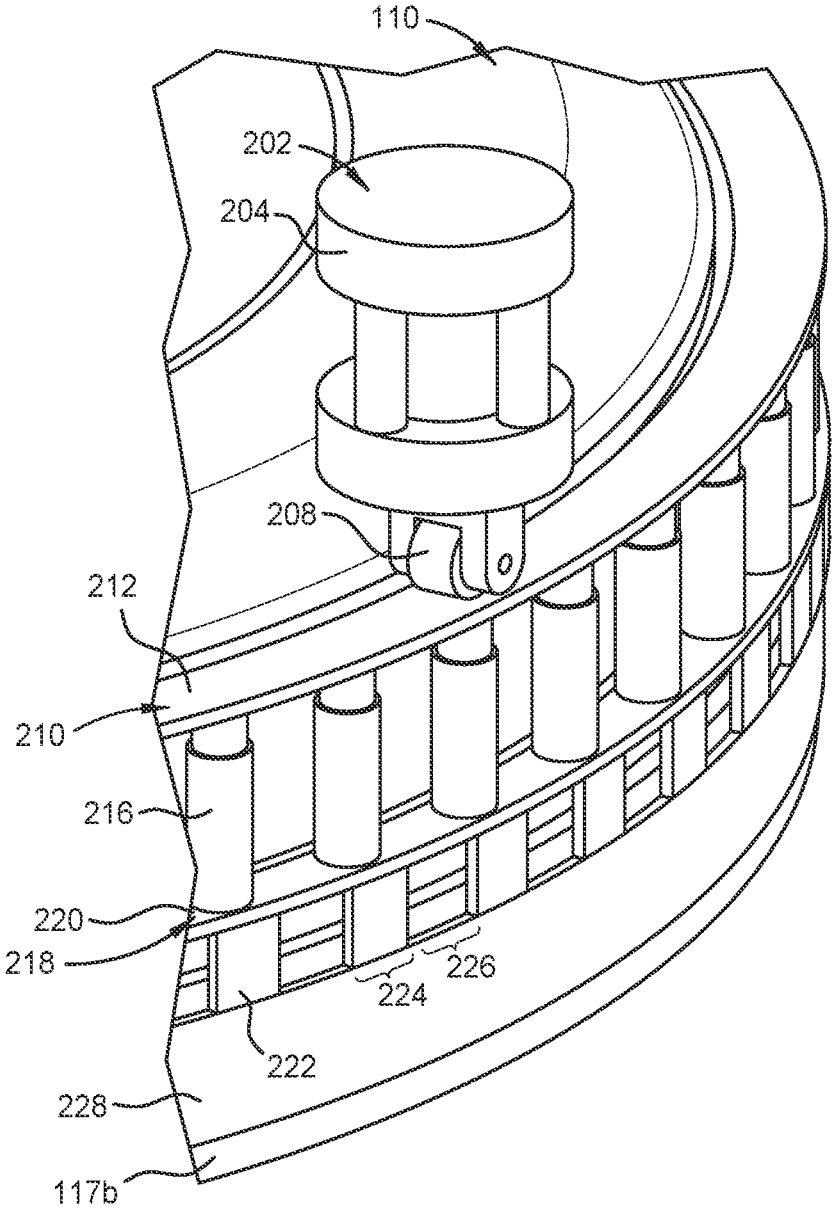
FIG. 2C is an enlarged isometric view of a portion of FIG. 2A.

FIG. 2A is a schematic side view of one embodiment of a substrate carrier 110 that may be used in the polishing system 101 of FIG. 1B. FIG. 2B is an enlarged side sectional view of a portion of FIG. 2A. FIG. 2C is an enlarged isometric view of a portion of FIG. 2A. In FIG. 2C, the housing 111 and retaining ring 115 are removed in order to more clearly show internal components of the substrate carrier 110. The membrane 117 includes a bottom portion 117*a* spanning the inner diameter of the retaining ring 115 and a side portion 117*b* extending substantially parallel to an inner wall 115*a* of the retaining ring 115. An external actuator 202 (e.g., linear actuator) is coupled to the carriage arm 113. The external actuator 202 is disposed between the carriage arm 113 and the housing 111 of the substrate carrier 110. Although only one external actuator 202 is illustrated in FIGS. 2A-2C, it will be appreciated that a plurality of external actuators 202 may be disposed circumferentially about the carrier axis B. In some embodiments, the number of external actuators 202 may be from 1 to 12 external actuators, such as from 1 to 4 external actuators, such as from 4 to 12 external actuators, such as from 4 to 8 external actuators.

The external actuator 202 includes a cylindrical housing 204 coupled to a bottom side of the carriage arm 113. The cylindrical housing 204 is longitudinally oriented substantially along the z-axis (e.g., aligned in the direction of gravity). A piston 206 is partially disposed inside the cylindrical housing 204. The piston 206 is actuatable to extend and retract relative to the cylindrical housing 204 substantially along the z-axis (e.g., being vertically movable). In one embodiment, a roller 208 is coupled to a distal end of the piston 206 using a fastener (e.g., a clamp). The roller 208 is configured to contact the housing 111 to transfer a load from the external actuator 202 to the housing 111 or to one or more components of the housing which are described in detail below. The roller 208 enables load transfer to the carrier head 110 during operation (e.g., when the external actuator 202 is stationary and the carrier head 110 is rotating).

The roller 208 contacts an upper load ring 210 disposed in the housing 111. The upper load ring 210 is an annular ring having an upper face 212 and a plurality of lower faces 214 opposite the upper face 212. In some embodiments, the upper load ring 210 has a continuous annular upper face. The upper face 212 is exposed through a top of the housing 111 for maintaining contact with the roller 208 during rotation of the carrier head 110. In some other embodiments (not shown), the upper load ring 210 includes a plurality of arc-shaped segments having a plurality of upper faces 212. Positioned below the upper load ring 210, a plurality of load pins 216 are disposed circumferentially about the carrier axis B of the substrate carrier 110. Each of the plurality of load pins 216 is longitudinally oriented substantially along the z-axis. The plurality of load pins 216 are more clearly depicted in FIG. 2C. As shown in FIG. 2C, the plurality of load pins 216 are uniformly spaced. In some embodiments, the plurality of load pins 216 may include from 6 to 36 load pins, such as from 12 to 24 load pins.

The plurality of load pins 216 are disposed vertically between the upper load ring 210 and a flange portion 220 of a lower load ring 218. A proximal end of each of the plurality of load pins 216 contacts one of the plurality of lower faces 214 of the upper load ring 210. A distal end of each of the plurality of load pins 216 is coupled to the flange portion 220 of the lower load ring 218 by a fastener (e.g., a machine screw). The lower load ring 218 includes a body portion 222 extending orthogonally to the flange portion 220. The body portion 222 extends substantially along the z-axis. The body portion 222 is disposed radially between the side portion 117*b* of the membrane 117 and the housing 111. An inner diameter of the body portion 222 is configured to engage the side portion 117*b* of the membrane 117. The body portion 222 includes a plurality of arc-shaped segments 224 having voids 226 between adjacent segments 224 (FIG. 2C). The segments 224 are aligned circumferentially with each of the plurality of load pins 216. The voids 226 are spaced between adjacent load pins 216. In some other embodiments (not shown), the body portion 222 may be a continuous annular ring without voids 226.

The side portion 117*b* of the membrane 117 includes an annular recess 117*c* formed along an outer edge of the side portion 117*b*. An outer diameter of the recess 117*c* is less than an outer diameter of the side portion 117*b*. An annular sleeve 228 is disposed in the recess 117*c*. An inner diameter of the sleeve 228 is configured to fit the outer diameter of the recess 117*c*. An outer diameter of the sleeve 228 is greater than the outer diameter of the side portion 117*b*. A distal end of the body portion 222 of the lower load ring 218 engages a top edge of the sleeve 228 which is radially exposed outside the recess 117*c*. The segments 224 of the lower load ring 218 concentrate the load applied by each of the plurality of load pins 216 to the underlying circumferential portion of the sleeve 228. The voids 226 (FIG. 2C) increase compliance of the lower load ring 218 in the z-direction. The side portion 117*b* of the membrane 117 surrounding the recess 117*c* is partially disposed, along the z-axis, between a bottom edge of the sleeve 228 and the substrate 122. A lower end of the side portion 117*b* is in contact with the edge of the substrate 122. Therefore, applying downward force to the sleeve 228 increases pressure between the edge of the substrate 122 and the polishing pad 106.

In operation, actuation of the external actuator 202 extends the piston 206 downward which applies a downforce against the upper load ring 210 via the roller 208. The downforce applied to the upper load ring 210 is ultimately transmitted to the edge of the substrate 122 by a load path which passes through the plurality of load pins 216, the lower load ring 218, the sleeve 228, and the side portion 117*b* of the membrane 117. Therefore, actuation of the external actuator 202 causes an outer radial portion of the membrane 117 to receive a load in a narrow region of the outer edge of the membrane 117 and substrate 122, which can tend to cause the bottom portion 117*a* to tilt in relation to the x-y plane. In particular, the narrowly distributed load on the outer edge of the membrane 117 and/or subsequent tilting of the membrane 117 will tend to form a negative taper, which corresponds to greater downward deflection of the bottom portion 117*a* moving radially outward from a center axis to the outer edge of the membrane 117. The narrowly distributed load on the outer edge of the membrane 117 alters the pressure applied between the substrate 122 and the polishing pad 106.

In certain embodiments, the pressure applied to the edge of the substrate 122 may be locally controlled. In other words, the pressure applied by each of the external actuators 202 may be localized to an arc-shaped region of the substrate 122 disposed underneath one or more active, load applying, external actuators 202. In some embodiments, the length of the arc-shaped region corresponding to localized pressure control may be about 90° or less, such as about 60° or less, such as about 45° or less, such as about 30° or less, such as about 30° to about 90°. Thus, pressure between the substrate 122 and the polishing pad 106 can be locally controlled within distinct circumferential regions by timing actuation of each of the plurality of external actuators 202. By orienting and positioning the external actuators 202 at desired positions or orientations relative to the platen 102 and/or carriage assembly 114, the pressure applied by the external actuators 202 can be applied at any instant in time to one or more desired regions of the membrane 117 during processing. In one example, the one or more desired regions can include portions of the membrane that are near a leading edge or a trailing edge of the carrier head 110 at any instant in time as the carrier head 110 is rotated and moves across the polishing pad 106 during processing. As disclosed herein the carrier head 110 can be moved in a direction that is along the radius of the platen, moved in a direction that is tangential to the radius of the platen, or moved in an arc shaped direction relative to the radius of the platen.

In some other embodiments (not shown), which may be combined with other embodiments described herein, the plurality of load pins 216 may be linear actuators or piezoelectric actuators which are configured to independently apply a downward force against the lower load ring 218.

In some embodiments (not shown), the upper load ring 210 is coupled to the annular sleeve 228. In such embodiments, the upper load ring 210, the plurality of load pins 216, and the lower load ring 218 form one continuous structure, or piece, extending from a load applying shaft of the external actuator 202 to the annular sleeve 228.

Figure 3A:
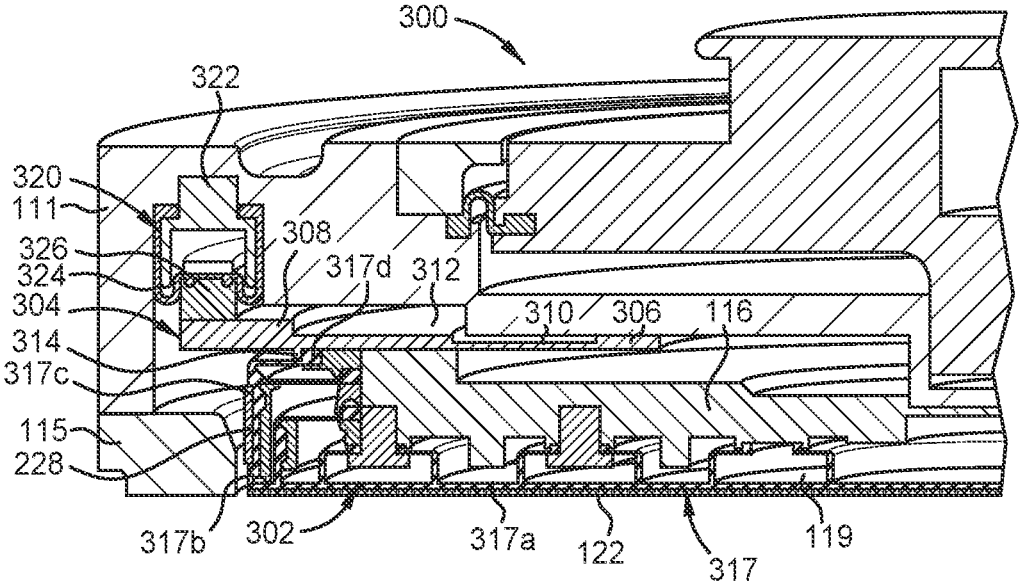
FIG. 3A is a side sectional view of yet another embodiment of a substrate carrier that may be used in the polishing system of FIG. 1B.

FIG. 3A is an enlarged side sectional view of another embodiment of a substrate carrier 300 that may be used in the polishing system 101 of FIG. 1B. In this example, the substrate carrier 300 includes a decoupled membrane assembly 302. A flexure plate 304 is disposed between the housing 111 and the base assembly 116 for flexibly coupling the membrane assembly 302 to the housing 111. The flexure plate 304 is an annular plate. The flexure plate 304 has an inner flange 306 for coupling the flexure plate 304 to the housing 111. The flexure plate 304 has an outer flange 308 for coupling the flexure plate 304 to an innertube 320.

In general, the innertube 320 (described in more detail below) is operable to apply a downward force to the outer flange 308 of the flexure plate 304 along the z-axis. The flexure plate 304 also has a flexure section 310 and a body section 312 which are radially adjacent to each other and extending between the inner flange 306 and the outer flange 308. The flexure section 310 is thinner than each of the inner flange 306 and the outer flange 308 and the body section 312 such that bending of the flexure plate 304 is primarily concentrated within the flexure section 310.

The innertube 320 is disposed within the housing 111 of the substrate carrier 300. The innertube 320 is annular or arc-shaped. The innertube 320 includes an upper clamp 322 and a lower clamp 324 which are in mating engagement with each to form a pressurized bladder. A connecting element 326 has an upper end contacting the lower clamp 324 and a lower end contacting the outer flange 308 of the flexure plate 304. Pressurization of the innertube 320 exerts a downward force against the outer flange 308 of the flexure plate 304 generating a torsional moment in the flexure plate 304 and causing the outer flange 308 and the body section 312 to deflect toward the decoupled membrane assembly 302. In particular, an annular protrusion 314 formed along a bottom surface of the flexure plate 304 contacts an upper portion 317*d* of the decoupled membrane assembly 302. Therefore, application of downward force to the flexure plate 304 causes an outer radial portion of the membrane assembly 302, including the bottom portion 317*a* thereof, to receive a load in a narrow region of the outer edge of the membrane 317 and substrate 122, which can tend to cause the bottom portion 317*a* to tilt in relation to the x-y plane. In particular, the narrowly distributed load on the outer edge of the membrane 317 and/or subsequent tilting of the membrane 317 will tend to form a negative taper, which corresponds to greater downward deflection of the bottom portion 317*a* moving radially outward from a center axis to an outer edge of the membrane 317. In some embodiments, the narrowly distributed load received by the membrane assembly 302 can be locally controlled to produce a selectively distributed load on the substrate 122 along an outer radial portion of the membrane 317.

Figure 3B:
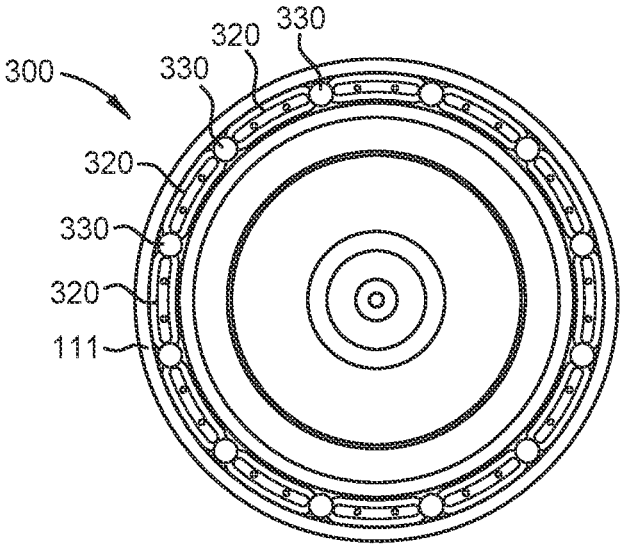
FIG. 3B is a schematic top view of the substrate carrier of FIG. 3A.

Although only one innertube 320 is illustrated in FIG. 3A, it will be appreciated that a plurality of innertubes 320 may be disposed circumferentially about the carrier axis B. FIG. 3B is a schematic top view of the substrate carrier 300 of FIG. 3A illustrating the positions of the plurality of innertubes 320. Referring to FIG. 3B, the substrate carrier 300 includes 12 separate arc-shaped innertubes 320. However, other numbers of innertubes 320 are also contemplated. In some embodiments, the number of innertubes 320 may be from 1 to 16 innertubes, such as from 1 to 4 innertubes, such as from 4 to 16 innertubes, such as from 8 to 12 innertubes. In some embodiments, the length of each innertube 320 may be about 90° or less, such as about 60° or less, such as about 45° or less, such as about 30° or less, such as about 30° to about 90°.

In certain embodiments illustrated in FIGS. 3A-3B, the pressure applied to the edge of the substrate 122 may be locally controlled. In other words, the pressure may be localized to an arc-shaped region of the substrate 122 disposed underneath one or more pressurized innertubes 320. Thus, pressure between the substrate 122 and the polishing pad 106 can be locally controlled within distinct circumferential regions by timing pressurization of each of the plurality of innertubes 320 as the carrier head 110 is rotated about axis B during processing.

Referring to FIG. 3B, the substrate carrier 300 includes a plurality of internal actuators 330 disposed circumferentially about the carrier axis B. Although 12 internal actuators 330 are illustrated in FIG. 3B, other numbers of internal actuators 330 are also contemplated. In some embodiments, the number of internal actuators 330 may be from 1 to 16 internal actuators, such as from 1 to 4 internal actuators, such as from 4 to 16 internal actuators, such as from 8 to 12 internal actuators. Referring to FIG. 3B, the number of internal actuators 330 in the substrate carrier is equal to the number of innertubes 320. However, in some other embodiments (not shown), the number of internal actuators 330 and innertubes 320 are different.

The plurality of internal actuators 330 may be similar in structure and function to the external actuator 202. In general, the plurality of internal actuators 330 include a cylindrical housing 332 and a piston 334. The piston 334 is partially disposed inside the cylindrical housing 332. The piston 334 is actuatable to extend and retract relative to the cylindrical housing 332 substantially along the z-axis.

Figure 3C:
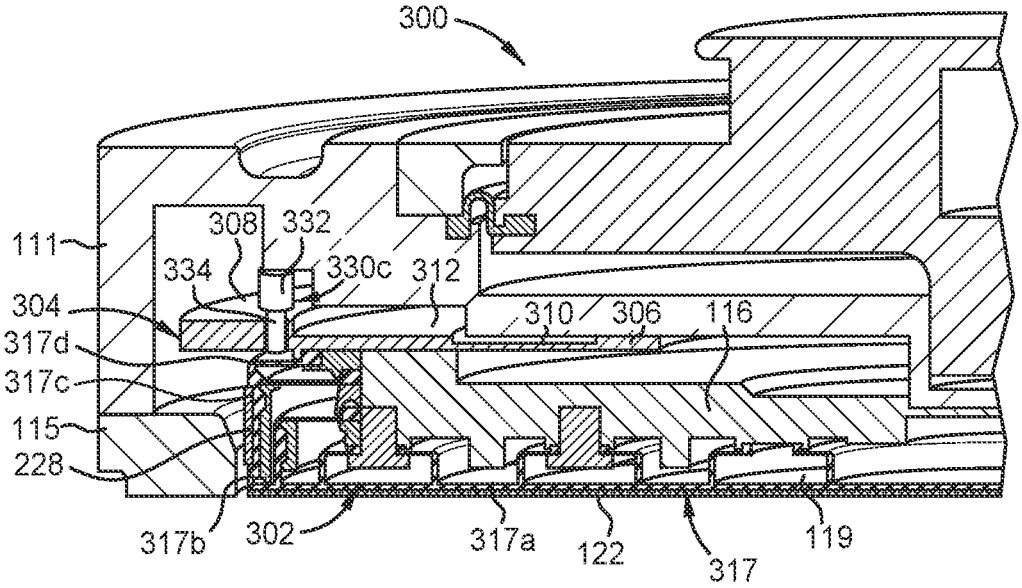
FIGS. 3C and 3D are enlarged side sectional views of a portion of FIG. 3B illustrating internal actuators according two different embodiments.
Figure 3D:
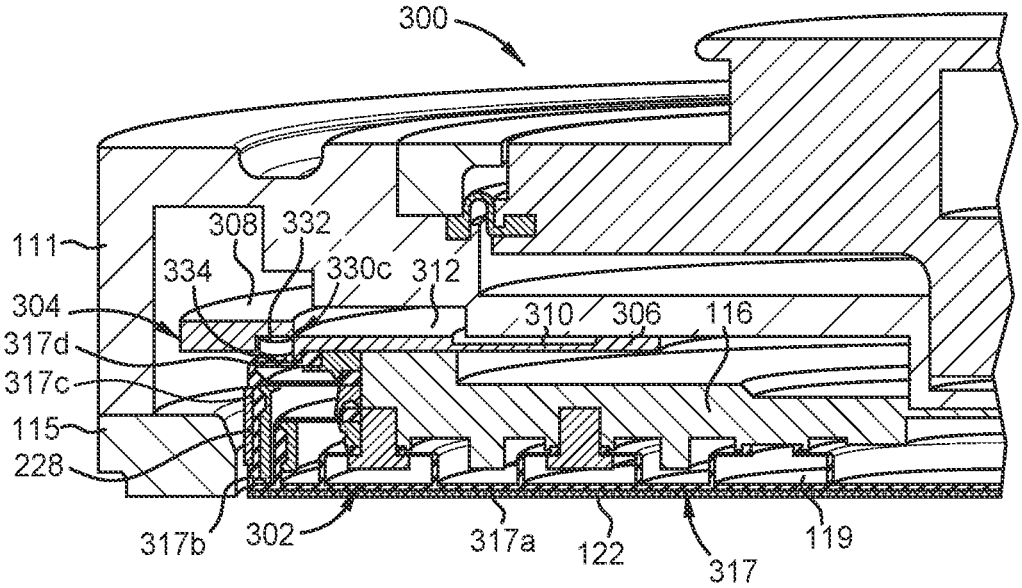

FIGS. 3C and 3D are enlarged side sectional views of a portion of FIG. 3B illustrating the internal actuators 330 according to two different embodiments. Referring collectively to FIGS. 3C and 3D, each of the internal actuators 330*c-d* is configured to contact the upper portion 317*d* of the decoupled membrane assembly 302. A distal end of the piston 334 contacts the upper portion 317*d* of the membrane 317 to apply a downward force thereto. Referring to FIG. 3C, the piston 334 of the internal actuator 330*c* extends through a hole formed in the flexure plate 304 to contact the upper portion 317*d* of the membrane 317. On the other hand, referring to FIG. 3D, each of the plurality of internal actuators 330*d* is disposed between the flexure plate 304 and the upper portion 317*d* of the membrane 317. In particular, the cylindrical housing 332 is fixedly coupled to the flexure plate 304. The cylindrical housing 332 is at least partially disposed in a corresponding recess formed in the bottom surface of the outer flange 308 of the flexure plate 304. The piston 334 extends below the bottom surface of the outer flange 308 of the flexure plate 304 and contacts the upper portion 317*d* of the membrane 317.

In the embodiments of FIGS. 3C and 3D, the effect of the plurality of internal actuators 330*c-d* allows a narrowly distributed load to be applied to the outer edge of the membrane 317 and substrate 122, which can result in tilting of the membrane assembly 302 similar to the plurality of innertubes 320 described above. The plurality of innertubes 320 and internal actuators 330*c-d* can each be independently actuated to provide even more precise control of pressure between the substrate 122 and the polishing pad 106 compared to using only one or the other of the plurality of innertubes 320 or internal actuators 330*c-d* alone.

While the overall effect of the embodiments of FIGS. 3C and 3D may be similar, the force coupling mechanism between the plurality of innertubes 320 and internal actuators 330*c-d* is different. In FIG. 3C, the forces applied by the plurality of innertubes 320 and internal actuators 330*c* are decoupled from each other, which means that each of the forces is applied independently of the other. However, in FIG. 3D, the forces are not decoupled from each other. In other words, even though the plurality of innertubes 320 and internal actuators 330*d* are independently actuatable, the applied forces are actually coupled to each other through the flexure plate 304. For example, a downward force applied by one or more of the internal actuators 330*d* against the membrane 317 results in an equal and opposite reaction force which is applied in an upward direction against the bottom surface of the flexure plate 304. The resulting upward force acts in a direction that is opposite a downward force applied against the flexure plate 304 by one or more of the innertubes 320.

Each of the embodiments of FIGS. 3C and 3D has certain unique advantages. Turning to the embodiment of FIG. 3C, because the plurality internal actuators 330*c* act against the flexure plate 304 as opposed to acting directly against the membrane 317, the plurality of internal actuators 330*c* can be disposed within the housing 111 where adequate space is available for housing the plurality of internal actuators 330*c* significant design modification. Moreover, disposing the plurality of internal actuators 330*c* above the flexure plate 304 makes the plurality of internal actuators 330*c* less susceptible to the effects of the slurry contamination. In some embodiments (not shown), additional sealing mechanisms may be incorporated into the substrate carrier 300 to prevent slurry contamination. For example, one or more sliding seals may be disposed between the piston 334 of the internal actuator 330*c* and the flexure plate 304 to enhance sealing therebetween. Turning now to the embodiment of FIG. 3D, because the plurality internal actuators 330*d* act directly against the membrane 317 as opposed to acting against the flexure plate 304, the plurality of internal actuators 330*d* are able to generate the same narrowly distributed load on the outer edge of the membrane 317 and/or tilt of the membrane 317 with less displacement of the piston 334, which allows shorter actuators to be used.

Figure 4:
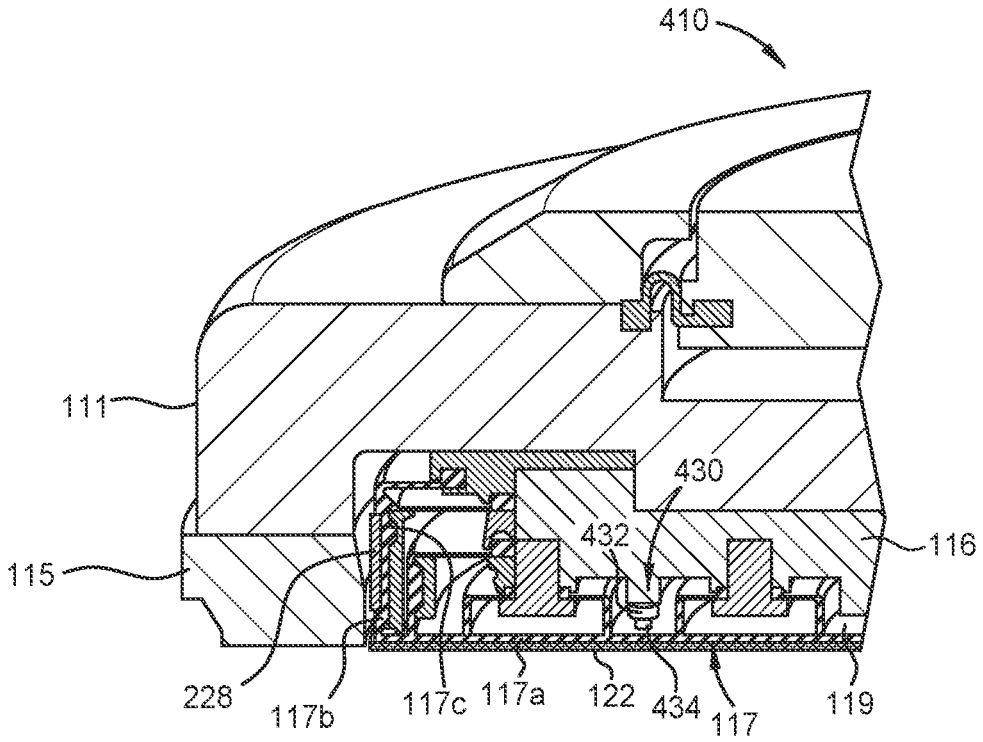
FIG. 4 is a side sectional view of yet another embodiment of a substrate carrier that may be used in the polishing system of FIG. 1B.

FIG. 4 is a side sectional view of another embodiment of a substrate carrier 410 that may be used in the polishing system 101 of FIG. 1B. The embodiment of FIG. 4 may be combined with other embodiments described herein. The substrate carrier 410 includes an internal actuator 430 coupled to the base assembly 116. The internal actuator 430 may be similar in structure and function to the external actuator 202 and/or the internal actuators 330, 340. In general, the internal actuator 430 includes a cylindrical housing 432 and a piston 434. The cylindrical housing 432 is coupled to a bottom side of the base assembly 116. The piston 434 is partially disposed inside the cylindrical housing 432. The piston 434 is actuatable to extend and retract relative to the cylindrical housing 432 substantially along the z-axis. The piston 434 is configured to contact the bottom portion 117*a* of the membrane 117 to transfer a load from the internal actuator 430 to the substrate 122 via the membrane 117.

Although only one internal actuator 430 is illustrated in FIG. 4, it will be appreciated that a plurality of internal actuators 430 may be disposed in one or more concentric rings about the carrier axis B. In some embodiments (not shown), the number of internal actuators 430 in each concentric ring may be from 1 to 12 external actuators, such as from 1 to 4 external actuators, such as from 4 to 12 external actuators, such as from 4 to 8 external actuators. In some other embodiments (not shown), the plurality of internal actuators 430 includes an array of internal actuators 430 disposed at different radial distances from the carrier axis B. In some embodiments (not shown), one or more pressure zones of the membrane 117 include a ring of internal actuators 430. In certain embodiments, pressure between the substrate 122 and the polishing pad 106 can be locally controlled within distinct circumferential and radial regions by timing actuation of each of the plurality of internal actuators 430.

While the foregoing is directed to embodiments of the present disclosure, other and further embodiments of the disclosure may be devised without departing from the basic scope thereof, and the scope thereof is determined by the claims that follow.

The invention claimed is:

1. A polishing system, comprising:

a carriage arm;

a substrate carrier coupled to the carriage arm, the substrate carrier comprising:

a housing;
a retaining ring coupled to the housing;
a membrane that is configured to urge a substrate against a surface of a polishing pad, the membrane comprising:
a bottom portion configured to contact the substrate;
an upper portion opposite the bottom portion;
a side portion extending orthogonally between the bottom portion and the upper portion; and
an outer edge connecting the side portion to the bottom portion;
an annular sleeve is disposed in an annular recess formed along the outer edge of the side portion; and
an upper load ring coupled to the annular sleeve; and
an actuator coupled to the carriage arm, the actuator comprising a piston that engages the upper portion of the membrane,
wherein the actuator is disposed on the outer edge of the membrane, and configured to apply a load to the outer edge of the membrane via the annular sleeve thereby altering an amount of pressure applied between the substrate disposed in the substrate carrier and the polishing pad, and
wherein the load applied to the outer edge of the membrane is applied by the piston applying a load to the upper portion of the membrane.

2. The polishing system of claim 1, wherein the substrate carrier further comprises a flexure plate coupled to the housing.

3. The polishing system of claim 2, wherein the piston of the actuator is disposed through a hole formed in the flexure plate.

4. The polishing system of claim 2, wherein the actuator is disposed on a lower surface of the flexure plate.

5. The polishing system of claim 1, wherein the actuator further comprises a load applying shaft configured to apply the load to a portion of the upper load ring, the annular sleeve, and the outer edge of the membrane.

6. The polishing system of claim 5, wherein the actuator further comprises a roller coupled to a distal end of the load applying shaft, wherein the roller of the actuator is configured to contact the upper load ring during relative rotation between the substrate carrier and the carriage arm.

7. The polishing system of claim 1, wherein the substrate carrier further comprises:
a lower load ring disposed in the housing; and
a plurality of load pins disposed circumferentially in the housing, each of the plurality of load pins having a proximal end coupled to the upper load ring and a distal end coupled to the lower load ring.

8. The polishing system of claim 7, wherein the upper load ring is disposed in the housing.

9. The polishing system of claim 8, wherein the lower load ring comprises a flange portion coupled to the distal end of each of the plurality of load pins and a body portion extending orthogonally in relation to the flange portion, wherein the body portion contacts the annular sleeve disposed in the membrane.

10. A polishing system, comprising:
a carriage arm;
a substrate carrier coupled to the carriage arm, the substrate carrier comprising:
a housing;
a retaining ring coupled to the housing;
a membrane that is configured to urge a substrate against a surface of a polishing pad, the membrane comprising:
a bottom portion configured to contact the substrate;
an upper portion opposite the bottom portion;
a side portion extending orthogonally between the bottom portion and the upper portion; and
an outer edge connecting the side portion to the bottom portion;
an annular sleeve in an annular recess formed along the outer edge of the side portion;
an upper load ring coupled to the annular sleeve;
an actuator comprising an innertube disposed within the housing; and
a flexure plate coupled to the housing,
wherein the actuator is coupled to the carriage arm and disposed on the outer edge of the membrane and configured to apply a load to the outer edge of the membrane via the annular sleeve thereby altering an amount of pressure applied between the substrate disposed in the substrate carrier and the polishing pad, and
wherein the innertube is configured to apply the load to a portion of the flexure plate thereby altering the pressure applied between the substrate disposed in the substrate carrier and the polishing pad.

11. The polishing system of claim 10, wherein a protrusion of the flexure plate engages the upper portion of the membrane to apply the load.

12. The polishing system of claim 10, wherein the actuator further comprises a load applying shaft configured to apply the load to the outer edge of the membrane.

13. The polishing system of claim 12, wherein the actuator further comprises a roller coupled to a distal end of the load applying shaft, wherein the roller of the actuator is configured to contact the upper load ring during relative rotation between the substrate carrier and the carriage arm.

14. The polishing system of claim 13, further comprising:
a plurality of load pins disposed circumferentially in the housing, each of the plurality of load pins having a proximal end coupled to the upper load ring and a distal end coupled to a lower load ring; and
the lower load ring disposed in the housing,
wherein the actuator is configured to apply a load to a portion of the upper load ring, one or more of the plurality of load pins, lower load ring, the annular sleeve, and the outer edge of the membrane thereby altering the pressure applied between the substrate and the polishing pad.

15. A polishing system, comprising:
a carriage arm;
an actuator disposed on a lower surface of the carriage arm, the actuator comprising:
a piston; and
a roller coupled to a distal end of the piston;
a polishing pad; and
a substrate carrier suspended from the carriage arm and configured to apply a pressure between a substrate and the polishing pad, the substrate carrier comprising:
a housing;
a retaining ring coupled to the housing;
a membrane coupled to the housing and spanning an inner diameter of the retaining ring, the membrane comprising:
a bottom portion configured to contact the substrate;
an upper portion opposite the bottom portion;
a side portion extending orthogonally between the bottom portion and the upper portion; and
an outer edge connecting the side portion to the bottom portion;

an annular sleeve disposed in an annular recess formed along the outer edge of the side portion;

an upper load ring configured to contact the housing, wherein the roller of the actuator is disposed on the outer edge of the membrane and configured to contact the upper load ring during relative rotation between the substrate carrier and the carriage arm;

a plurality of load pins disposed circumferentially in the housing, each of the plurality of load pins having a proximal end coupled to the upper load ring and a distal end coupled to a lower load ring; and the lower load ring disposed in the housing, wherein the actuator is configured to apply a load to the outer edge of the membrane via the annular sleeve thereby altering the pressure applied between the substrate disposed in the substrate carrier and the polishing pad.

16. The polishing system of claim 15, wherein the substrate carrier further comprises a flexure plate coupled to the housing.

17. The polishing system of claim 16, wherein the piston of the actuator is disposed through a hole formed in the flexure plate.

18. The polishing system of claim 16, wherein the actuator is disposed on a lower surface of the flexure plate, wherein the load applied to the upper portion of the membrane is applied via the annular sleeve.

19. The polishing system of claim 15, wherein the actuator further comprises a load applying shaft configured to apply the load to a portion of the upper load ring, the annular sleeve, and the outer edge of the membrane.

20. The polishing system of claim 19, wherein the actuator further comprises a roller coupled to a distal end of the load applying shaft, wherein the roller of the actuator is configured to contact the upper load ring during relative rotation between the substrate carrier and the carriage arm.

* * * * *